US009502796B2

(12) United States Patent
Genau

(10) Patent No.: US 9,502,796 B2
(45) Date of Patent: Nov. 22, 2016

(54) PLUG CONNECTOR FOR DIFFERENTIAL DATA TRANSMISSION

(75) Inventor: Melanie Genau, Luebbecke (DE)

(73) Assignee: HARTING ELECTRONICS GMBH & CO. KG, Espelkamp (DE)

( * ) Notice: Subject to any disclaimer, the term of this patent is extended or adjusted under 35 U.S.C. 154(b) by 0 days.

(21) Appl. No.: 13/816,837

(22) PCT Filed: Aug. 10, 2011

(86) PCT No.: PCT/DE2011/075190
§ 371 (c)(1),
(2), (4) Date: Feb. 13, 2013

(87) PCT Pub. No.: WO2012/041310
PCT Pub. Date: Apr. 5, 2012

(65) Prior Publication Data

US 2013/0137310 A1 May 30, 2013

(30) Foreign Application Priority Data

Aug. 13, 2010 (DE) ..... 10 2010 034 269

(51) Int. Cl.
*H01R 24/00* (2011.01)
*H01R 12/70* (2011.01)
(Continued)

(52) U.S. Cl.
CPC ..... *H01R 12/70* (2013.01); *H01R 12/724* (2013.01); *H01R 13/504* (2013.01);
(Continued)

(58) Field of Classification Search
CPC ..... H01R 12/70; H01R 13/6471; H01R 13/501; H01R 4/027; H01R 13/504;
(Continued)

(56) References Cited

U.S. PATENT DOCUMENTS 4,449,779 A * 5/1984 Hampshire ..... 439/578
5,895,292 A 4/1999 Affeltranger
(Continued)

FOREIGN PATENT DOCUMENTS

CN 1885623 12/2006
CN 101127419 2/2008
(Continued)

*Primary Examiner* — Jean F Duverne
(74) *Attorney, Agent, or Firm* — Jacobson Holman, PLLC.

(57) ABSTRACT

A round plug-in connector has a connection side configured for contacting circuit boards. For transmitting several independent, differential signals, the plug-in connector includes electric contacts arranged in pairs, with each of four signal pairs being insulated from each other by a cruciform structure, and being arranged inside an electrically non-conductive round body surrounding the cruciform structure. An electrically conductive screen cross is surrounded by a cruciform contact carrier with accepting grooves in diagonally embodied internal edges for holding the electric contacts. The round body is pushed over the cruciform arrangement, and is surrounded by an electrically conductive housing. Connection ends of the electric contacts that are intended to be aligned precisely on a circuit board, via a positioning aid, are attached to the round body. The positioning aid includes respective bore holes for the connection ends of the electric contacts, which coincide with soldered bore holes on the circuit board.

16 Claims, 9 Drawing Sheets

(51) Int. Cl.

| | |
|---|---|
| ***H01R 12/72*** | (2011.01) |
| ***H01R 13/504*** | (2006.01) |
| ***H01R 13/6585*** | (2011.01) |
| ***H01R 13/6471*** | (2011.01) |
| *H01R 4/02* | (2006.01) |
| *H01R 13/50* | (2006.01) |
| *H01R 13/506* | (2006.01) |
| *H01R 13/631* | (2006.01) |
| *H01R 13/6583* | (2011.01) |
| *H01R 13/6587* | (2011.01) |
| *H01R 13/6596* | (2011.01) |
| *H01R 13/74* | (2006.01) |
| *H01R 107/00* | (2006.01) |

(52) U.S. Cl.
CPC ..... *H01R 13/6471* (2013.01); *H01R 13/6585* (2013.01); *H01R 4/027* (2013.01); *H01R 13/501* (2013.01); *H01R 13/506* (2013.01); *H01R 13/6315* (2013.01); *H01R 13/6583* (2013.01); *H01R 13/6587* (2013.01); *H01R 13/6596* (2013.01); *H01R 13/746* (2013.01); *H01R 2107/00* (2013.01)

(58) Field of Classification Search
CPC ..... H01R 12/724; H01R 13/746; H01R 13/6596; H01R 13/6315; H01R 13/6587; H01R 13/6585; H01R 2107/00; H01R 13/506
USPC ..... 439/660, 587, 607.43, 290, 392
See application file for complete search history.

(56) References Cited

U.S. PATENT DOCUMENTS

| | | | | |
|---|---|---|---|---|
| 6,077,122 | A | 6/2000 | Elkhatib et al. | |
| 6,080,018 | A | 6/2000 | Ferrill et al. | |
| 6,238,246 | B1 * | 5/2001 | Ferrill et al. | 439/607.47 |
| 6,805,590 | B2 * | 10/2004 | Kato | H01R 13/4367 439/638 |
| 6,863,545 | B2 * | 3/2005 | Peloza | H01R 12/7005 439/701 |
| 7,195,518 | B2 * | 3/2007 | Bert et al. | 439/607.43 |
| 7,575,476 | B2 * | 8/2009 | Tyler | H01R 13/65802 439/101 |
| 7,736,159 | B1 | 6/2010 | Effinger, III et al. | |
| 7,811,115 | B1 * | 10/2010 | Tyler | H01R 13/53 439/352 |
| 9,099,814 | B2 * | 8/2015 | Snader | H01R 13/5219 |
| 2002/0115346 | A1 | 8/2002 | Yip et al. | |
| 2006/0068618 | A1 | 3/2006 | Li et al. | |
| 2006/0246780 | A1 | 11/2006 | Bert et al. | |
| 2007/0259568 | A1 | 11/2007 | Mackillop et al. | |
| 2008/0045072 | A1 | 2/2008 | Heckmann et al. | |
| 2012/0034809 | A1 * | 2/2012 | Reimchen | H01R 9/03 439/362 |

FOREIGN PATENT DOCUMENTS

| | | |
|---|---|---|
| DE | 20 2004 014020 | 2/2006 |
| EP | 0 755 100 | 1/1997 |
| EP | 0 809 331 | 11/1997 |
| EP | 1858117 | 11/2007 |
| FR | 2 921 522 | 3/2009 |
| JP | 10-340759 | 12/1998 |
| JP | 2002151207 | 5/2002 |

* cited by examiner

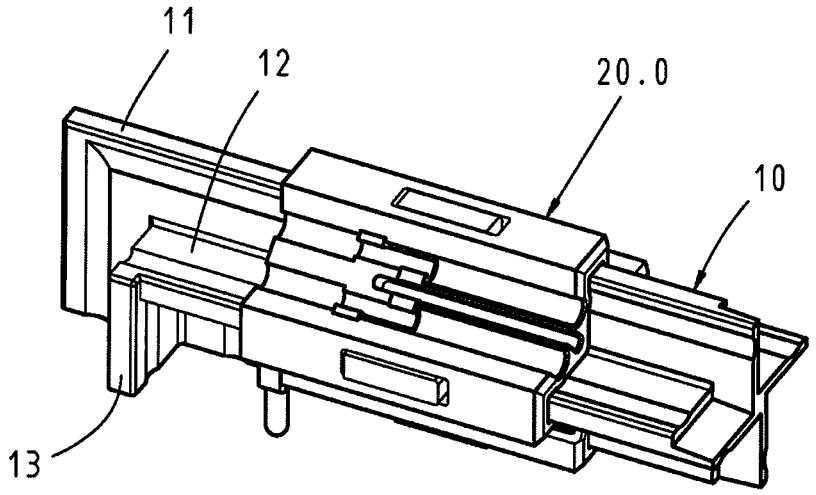
Fig. 2.0
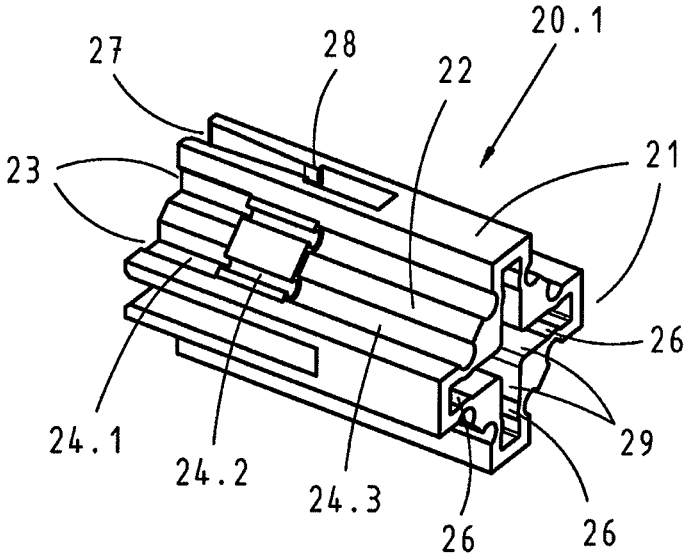
Fig. 2.1

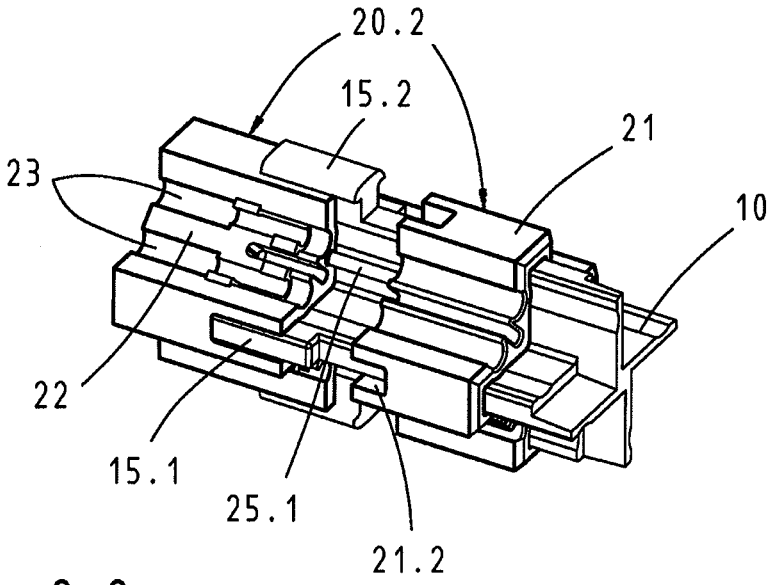
Fig. 2.2
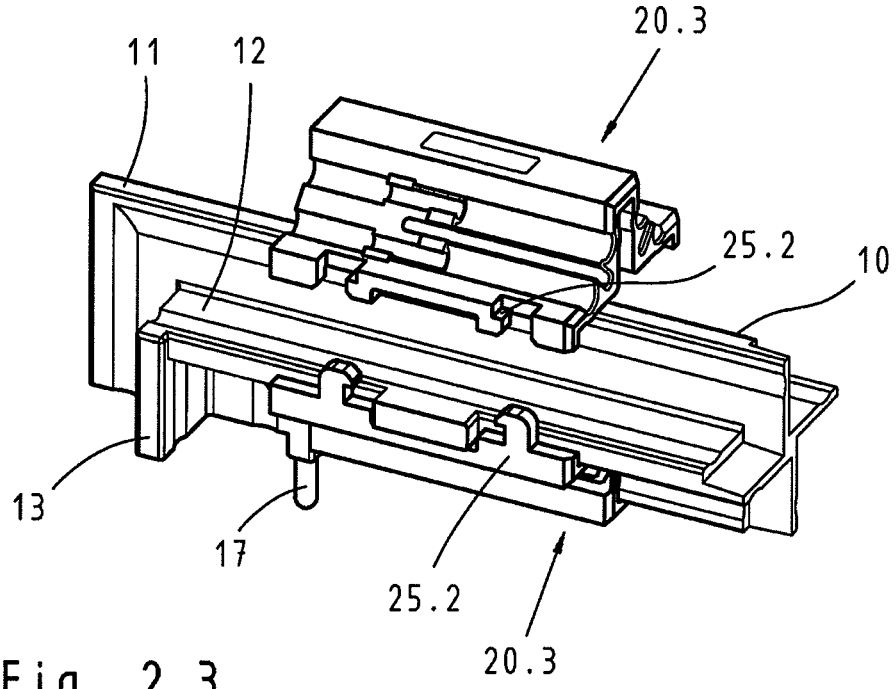
Fig. 2.3

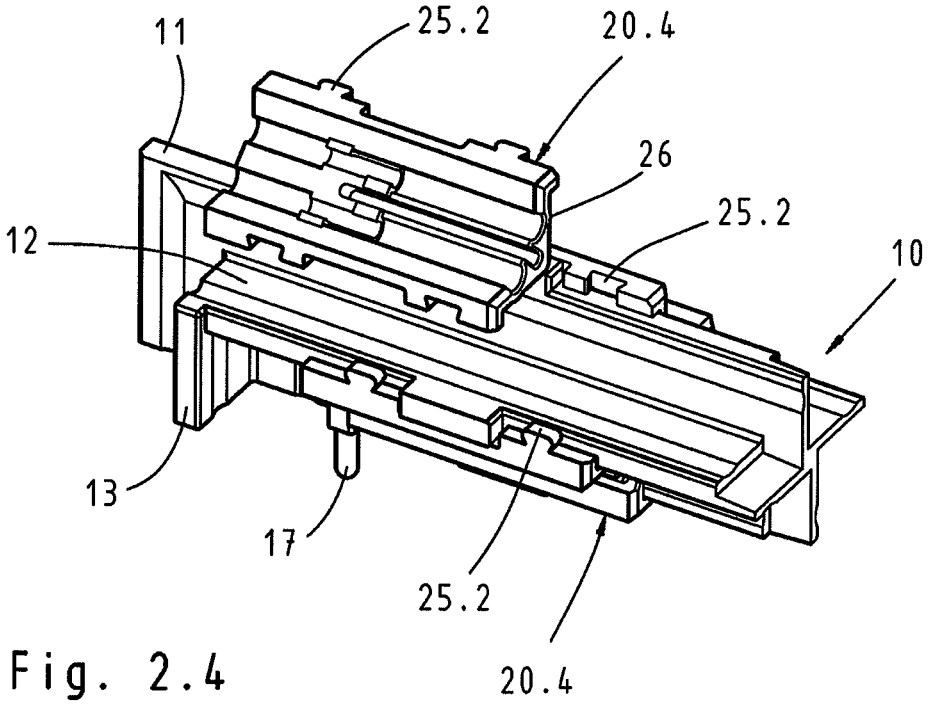
Fig. 2.4
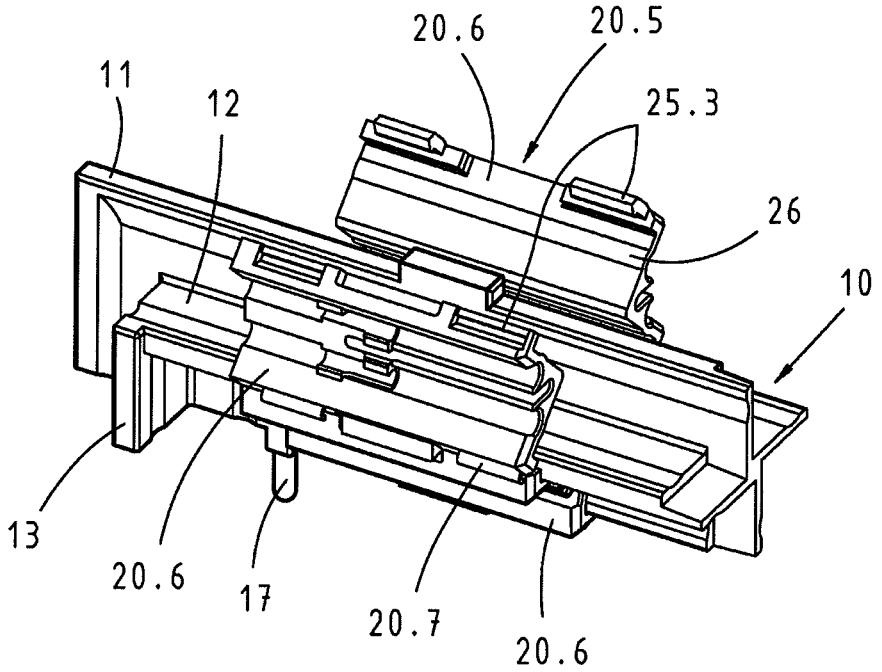
Fig. 2.5

PLUG CONNECTOR FOR DIFFERENTIAL DATA TRANSMISSION

CROSS-REFERENCE TO RELATED APPLICATIONS

This is a national stage of PCT/DE11/075190 filed Aug. 10, 2011 and published in German, which has a priority of German no. 10 2010 034 269.6 filed Aug. 13, 2010, hereby incorporated by reference.

BACKGROUND OF THE INVENTION

1. Field of Invention

The invention relates to a plug-in connector for a differential signal and data transmission, with several electric contacts, each being arranged in pairs in a segment of a cruciform connector structure.

Such a plug-in connector is required to ensure a best-possible transmission of signals over multiple twin-axial cable connections.

2. Description of the Prior Art

Plug-in connectors, with their four pairs of wires being provided for signal transmission, are almost considered prior art, even if various protective publications contradict it.

For example, EP 0 755 100 B1 already describes a "set of contacts for cables with twisted, individually insulated pairs of wires", in which four pairs of wires each are arranged in paired contact fasteners each at the exterior sides of a square connector body.

Furthermore, EP 0 809 331 B1 shows a multi-polar plug-in connection system, in which one pair of wires each is accepted in a separate guidance body, with the guidance body being separated by a cruciform structure, formed by a vertical and a horizontal separating wall.

These types of plug-in connectors are clearly intended for cable connections. In the meantime, however, decentralized peripheral devices have been developed for network technology, particularly for the Ethernet, in which external round plug-in connectors also must be connected, so that even in a decentralized distributor, round plug-in connectors are arranged on one or more circuit boards inside an insulating housing in a manner as cost-effective as possible.

SUMMARY OF THE INVENTION

The invention is therefore based on the objective to provide a plug-in connector suitable for the transmission of high-frequency signals, with several electric conductors, which are each to be arranged in pairs in one of several insulating chambers of a plug-in connector housing. Here, one variant is to be provided as an angled version as well as one version embodied straight for a circuit board assembly.

This objective is attained such that the cruciform structure for the plug-in connector is embodied from two walls, placed perpendicularly onto each other as the even-sided, longitudinally expanding and electrically conductive insulating cross, that corner sections with an internal edge are formed in the cruciform structure of the contact carrier, which show accepting grooves, in which axially-parallel aligned electric contacts are arranged, that the insulating cross is at least partially encompassed by an approximately cruciform contact carrier, made from an electrically insulating material, and that the contact carrier together with the electric contacts is surrounded by an electrically insulating round body.

Advantageous embodiments of the invention are described herein.

The invention relates to a round plug-in connector, accepting four differentially embodied signal lines with four chambers, separated from each other, for optimally insulating the four differential signal lines. Here it is advantageous that a cruciform longitudinal structure of the round plug-in connector is provided with one differential signal line inserted into the respective segments, thus two individual lines each.

For this purpose, a contact carrier is provided comprising an insulating material, which is intended as the carrier for electric contacts and comprises the insulating cross, in the form such that the contact carrier is injection molded directly around the shielding cross, and can be pushed onto the insulating cross or can be latched thereon in several parts.

Here, overall eight electric contacts, either provided with a socket or a pin on their plug-in side, are inserted into the appropriate accepting grooves, advantageously in the corner sections of the cruciform contact carrier.

For assembling a circuit board the connection ends are angled by approximately 90°, with here different lengths of the contacts result in order to yield a circular connection formation on the circuit board.

An insulating circular body is pushed onto this arrangement, showing four reference circle segments in their plug-in part, in which two of the electric contacts each are located.

This way, advantageously a continuously insulated signal transfer is possible, particularly since the insulating round body is always (provided with) a metallic, conductive housing in the form of a front-plate insert for the counter connector or even a complete electrically conducting housing surrounding the circuit board, inside which the internal plug-in connector can be connected to a counter-connector supplied from the outside.

For a precise alignment of the connection ends advantageously a positioning aid is provided, which at the connection side is fixated at the plug-in connector and shows bore holes according to the arrangement of the connections of the circuit board, so that the connection ends are precisely aligned to the connections of the circuit board.

Here, a gradual height distribution inside the circular arrangement of the bore holes is advantageous so that not all contacts of the circuit board must be connected by the positioning aid at the same time.

The electric contacts are embodied as wire contacts and are each snapped in longitudinal grooves in respective grooves in the four segments of the contact carrier so that the round body pushed over it securely accepts the contacts.

Here, the electric contacts are optionally embodied as male or female contacts.

The preferred round plug-in connector shown here is presented in a straight and an angular version and is designed for a direct assembly on circuit boards. However, a rectangular or square shape is also possible for the plug-in connector.

Furthermore it is intended to directly embed the electric contacts, next to the snap-in latches in the appropriate recesses of the contact carrier, in its plastic body.

In a preferred embodiment the plug-in connector is provided in an angular design for the assembly on a circuit board.

For this angular version for the first time an insulating cross has been developed such that advantageously the perpendicular deflection of the electric contacts is also considered so that the entire length of the contacts is insulated continuously from the plug-in side to the connection side on the circuit board.

Primarily it is intended that the plug-in connector initially shows no additional insulating external cover because the final assembly together with the circuit board occurs at least inside an insulating housing comprising all components.

In another embodiment, the plug-in connector may also be inserted into an electrically conductive sheath directly surrounding it.

However, applications are also provided to arrange one or more plug-in connectors fixated on a circuit board within an electrically non-conductive housing, with the plug-in connector being inserted into an electrically conductive front-plate insert inside an electrically conductive front plate so that the front-plate insert simultaneously forms a fastening option for the counter-connector to be plugged in.

Here, the plug-in connector and/or the round body are supported in a "floating fashion", i.e. only held on the circuit board, while the supplied counter-connector is advantageously held in a screwed connection of a front plate insert. Here, the screwed connection is formed as a sheath, namely reaching beyond the round plug-in connector without the two being connected to each other in a fixed fashion, however an insulating effect is yielded via the screen spring.

Furthermore, in another embodiment beneficially a straight design of the plug-in connector is intended to be assembled perpendicular on a circuit board.

Here, all inserted electric contacts show the same design.

BRIEF DESCRIPTION OF THE DRAWINGS

An exemplary embodiment of the invention is shown in the drawing and is explained in greater detail in the following. It shows:

FIG. 2.0 an isometric view of a screen cross with a contact carrier injection molded around it;

FIG. 2.1 an isometric view of a contact carrier to be pushed onto the screen cross;

FIG. 2.2 an isometric view of two contact carrier-halves for a mutual pushing onto the screen cross;

FIG. 2.3 an isometric view of a contact carrier comprising two longitudinal halves to be snapped onto the screen cross;

FIG. 2.4 an isometric view of a contact carrier comprising four segments to be snapped onto the screen cross;

FIG. 2.5 an isometric view of a contact carrier comprising four segments connected at film joints to be snapped on the screen cross;

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
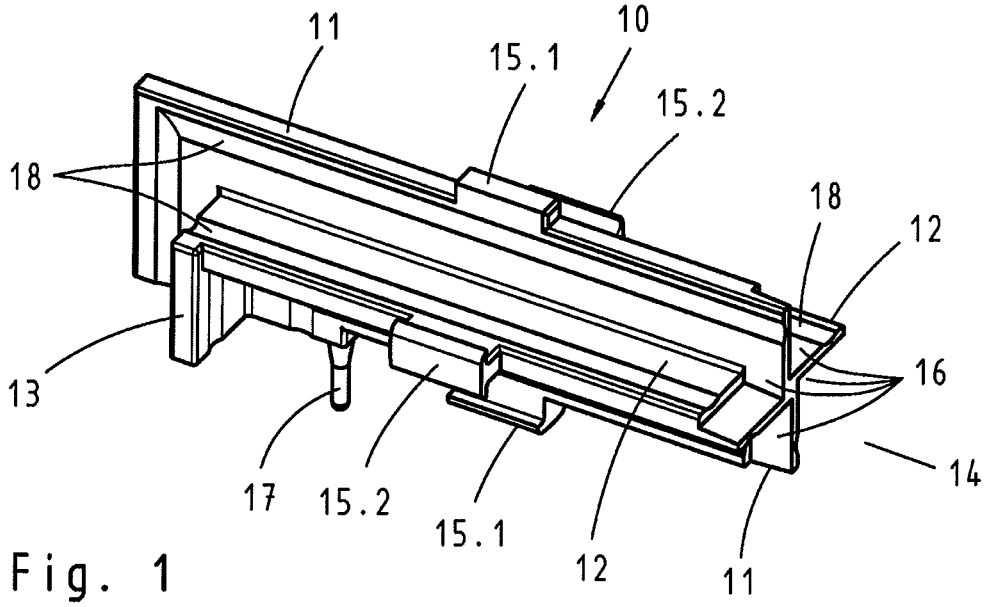
FIG. 1 an isometric view of the screen cross.

FIG. 1 shows an electrically conductive, axially expanding screen cross 10 for a plug-in connector 1, with here by the cruciform structure four semi-open quadrants 16 develop with electric contacts 30 are to be arranged in pairs therein.

The screen cross 10 is here formed from two walls 11, 12 aligned perpendicular in reference to each other, with here at both sides of the vertical wall 11 the angular version shown comprising two vertical walls 13 abutting the horizontal wall 12, in order to separate the upper and lower contacts 30 to be arranged here at a later time.

Furthermore, the vertical and horizontal walls 11, 12 each comprised on one side of axially-parallel aligned grooves 18, in which beads 26 intended for this purpose engage the respective sides of the contact carrier 20 and serve for guiding the contact carriers 20 described in the following.

Here, the plug-in side geometry of the screen cross is predetermined by standards.

Approximately centered in reference to the length of the screen cross 10, first and second snap formations are provided at the external edges of the vertical and horizontal walls 11, 12 and are respectively opposite thereto.

With the first snap, formations 15.1 are here provided for latching a contact carrier 20 and the second latching formations 15.2 for a round body 40 to be pushed on at a later time.

Furthermore, a ground pin 17 is provided at the screen cross 10 for an electric contacting with a circuit board 65.

FIG. 2.1 shows the basic example of a one-part contact carrier 20.1 with here the screen cross 10 can be inserted into its inner hollow space 29.

In the external corner sections of the contact carrier 20 one equal sided inner edge 22 each is axially aligned at an angle of approx. 45°, which edge in turn comprises two accepting grooves 23 respectively provided side-by-side.

The accepting grooves show different sections:
a first section 24.1 shows an angular internal edge, a second constricted section 24.2 is embodied as a round groove, and a third section 24.3 also comprising a round groove, but showing a larger diameter than the second section 24.2.

Furthermore, axial slots 27 with latching hooks 28 are provided along the external edges of the contact carrier 20.1, with two opposite round bodies 40 each being intended to latch on the one side the screen cross 10 to the first latch formations 15.1 and the two second latch formations 15.2, perpendicular in reference thereto, to latch to the round body 40 to be pushed onto the contact carrier 20.1

FIG. 2.0 shows a particular embodiment disclosing such a similar contact carrier 20.1 connected by injection molding directly and in one piece with the screen cross 10.

FIG. 2.2 shows a multi-part contact carrier 20.2 with here two segment parts being provided, each of which can be pushed from a side axially onto the screen cross and held together with a pin-shaped latching means 25.1 encompassing the screen cross 10 in the middle at both sides of the latch formations 15.1, 15.2. For this purpose, respective recesses 21.2 are provided at the centered meeting sections of the respective external edges 21 of the contact carrier 20.2.

FIG. 2.3 shows a multi-part contact carrier, which comprises two individual segments 20.3, embodied as similar half-shells and placed onto each other, surrounding the screen cross 10, latched to each other.

Furthermore, FIG. 2.4 shows four individual segments, but four similar segments 20.4, arranged around the screen cross 10, assembled and each latched to each other with latching means 25.2.

FIG. 2.5 ultimately shows a one-part contact carrier 20.5 here formed from four segments 20.6 each connected to each other via a film joint 20.7, placed around the screen cross 10, and with their ends can be latched to each other via latching means 25.3.

In the further description the different versions of the contact carrier are each called contact carrier 20 for reasons of simplification, because the external contours each show the same functional features.

Figure 3:
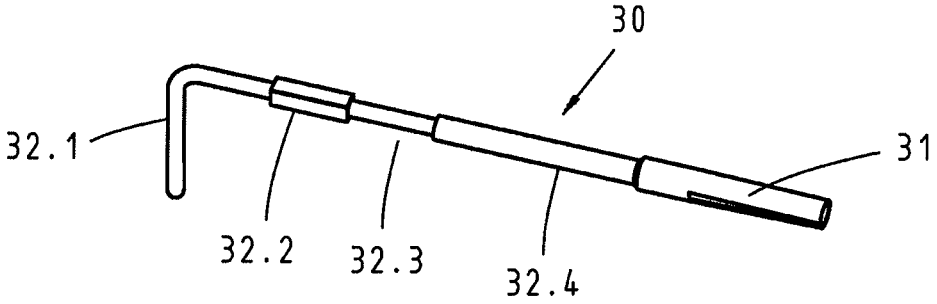
FIG. 3 a view of an electric contact.

FIG. 3 shows the wire-shaped electric contact 30, which comprises differently shaped sections, according to the differently shaped sections 24 in the accepting grooves 23 of the different contact carrier versions 20.

The plug-in side 31 of the electric contact 30 is either embodied as a pin or a socket, while the soldered side 32.1 is respectively angled by approx. 90° in reference to the axis.

The lengths of the electric contacts 30 vary, with always the $1^{st}$ section 32.1 with the angled soldered side being embodied shorter or longer.

Significantly, the next $2^{nd}$ section 32.2, in which the contact shows a four-sided form, which is inserted into the $1^{st}$ section 24.1 with the angular edge in the contact carrier 20. This way a first rough alignment of the soldered sides is yielded for the later assembly on the circuit board 65.

The $3^{rd}$ section 32.3 is altogether provided for latching and holding the contact 30 in the second section 24.2 of the contact carrier 20, while the $4^{th}$ section 32.4, with a slightly larger diameter, is inserted into the long guiding groove 24.3 of the $3^{rd}$ section of the contact carrier 20.

Figure 4:
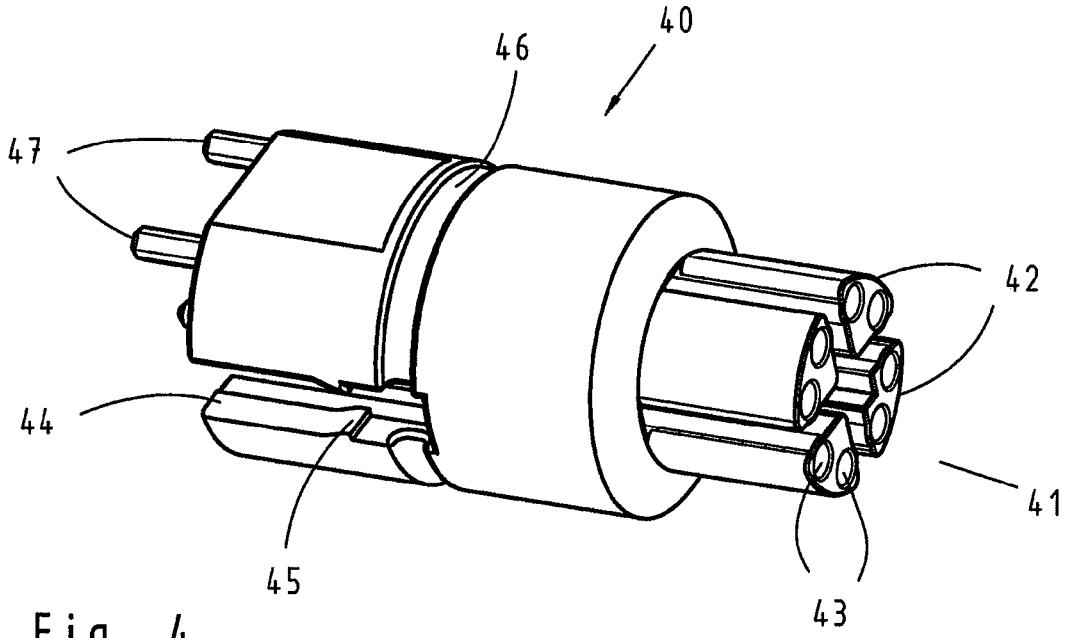
FIG. 4 an isometric view of a round body.

In another FIG. 4, the round body 40 is shown, which shall be pushed onto the cruciform structure comprising a screen cross 10 and a contact carrier 20.

The external round body 40, essentially showing round contours and comprising an electrically non-conductive material, is adjusted with its interior to the external cross shape of the contact carrier 20. Here, two opposite longitudinal slots 44 with latching hooks 45 are provided, with two latch formations 15.2 of the shielding cross 10 engaging for fixation.

A circumferential annular groove 46 is formed in the round body 40 with the end of the longitudinal slot 44, with a so-called screen spring 60 to be engaged, here. The screen spring may show a form deviating from the one shown here, though.

Furthermore, the round body 40 shows a plug-in side 41 with four reference circle segments 42, with respectively two bore holes 43 being formed therein for the plug-in sides 31 of the electric contacts 30 embodied as sockets or pins.

The vertical and horizontal walls 11, 12 of the screen cross 10 engage between these reference circle segments 42, at least partially. Here, it may also be possible to injection mold the round body directly around the contact carrier for an embodiment provided with pin contacts.

Figure 5:
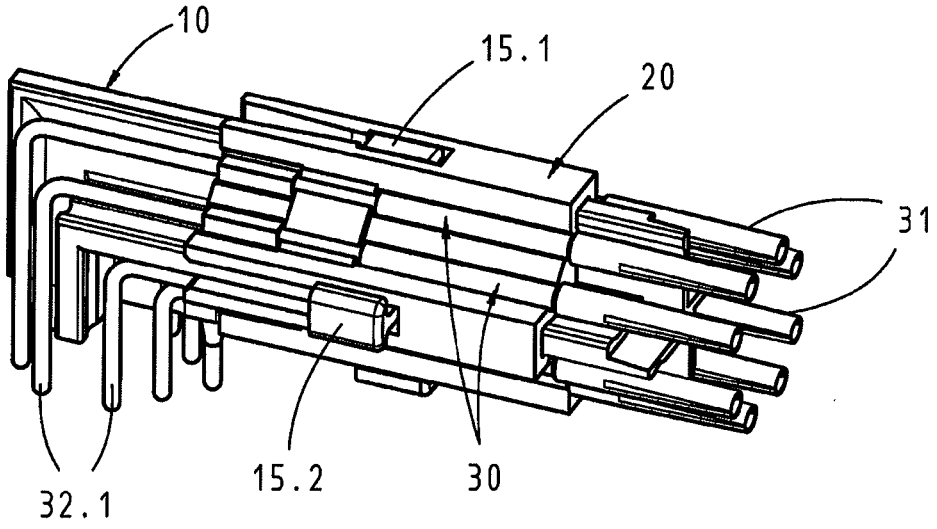
FIG. 5 an isometric view of assembled contacts in the contact carrier, positioned on the screen cross.

FIG. 5 shows an already partially assembled plug-in connector, which comprises a screen cross 10 with the pushed-on contact carrier 20 as well as the electric contacts 30 inserted therein.

Figure 6:
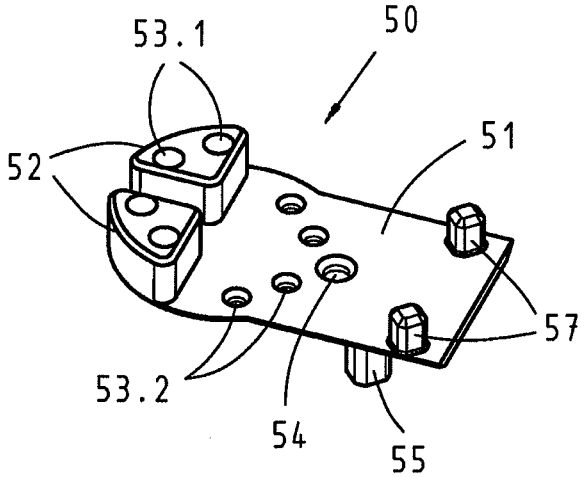
FIG. 6 an isometric view of a positioning aid.

FIG. 6 shows a positioning aid 50 for the alignment of the soldered sides 32.1 of the electric contacts 30, which are assembled at the round body 40 and inserted via a fixation pin 55 on the circuit board 65.

The positioning aid 50 is first embodied as a flat disk 51 with two quarter-circle sections 52 on an elevated level.

For example, when the positioning aids are applied the soldered sides 32.1 of the electric contacts 30 are only inserted into the bore holes 53.1 at the higher sections 52 and subsequently the remaining contacts (are inserted) into the bore holes 53.2 of the flat section 5.1

According to a deliberate circular arrangement of the connection ends 32.1 of the electric contacts 30, which can be soldered, the bore holes 53.1, 53.2 are arranged in the positioning aid 50.

Additionally a borehole 54 is additionally required for the ground pin 17 of the screen cross 10. Furthermore, at the side facing the round body 40 two pins 57 are formed for fastening in the round body 40, while at the opposite side at least one fixation pin 55 is provided for the circuit board 65.

Additionally, at the side of the positioning aid 50 facing the circuit board 65 a spacer is formed, not shown in greater detail here, in the form of an elevated, equal sided cross, for a distanced placement of the positioning aid on the circuit board 65.

Figure 7:
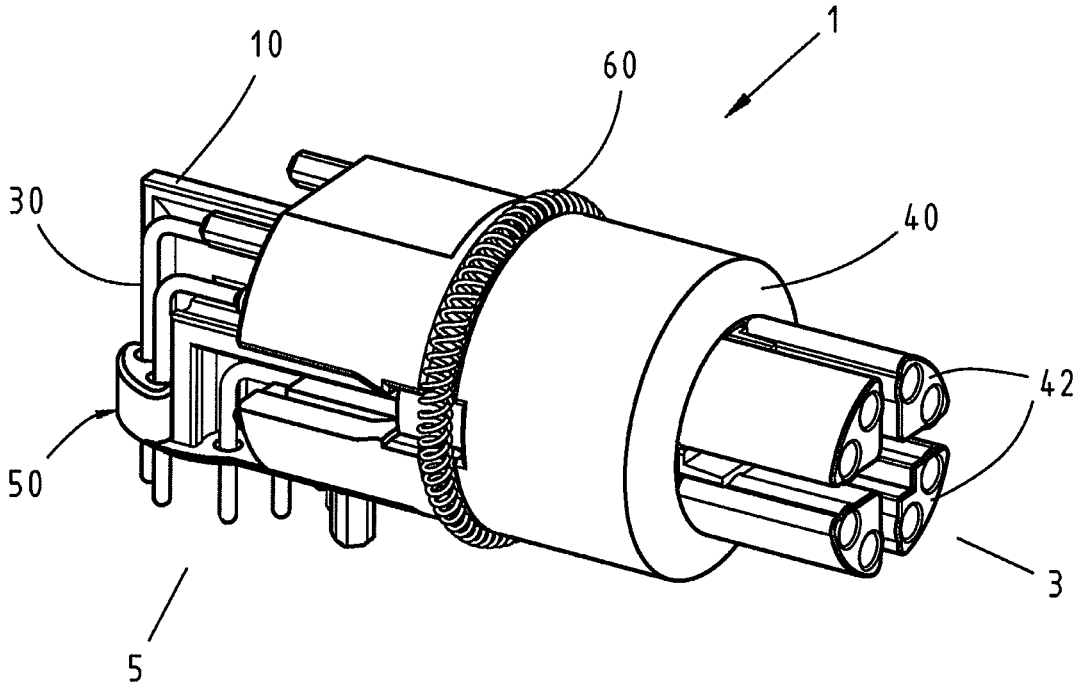
FIG. 7 an isometric view of a completely assembled plug-in connector.

FIG. 7 shows a plug-in connector 1, confectioned to a certain extent, with additionally a positioning aid 50 being fastened thereat.

The screen spring 60 in the circumferential groove 46 is discernible on the round body 40, by which the contacting to a front plate insert 75 is ensured, described in the following.

A screen spring 60, here shown in the form of a helical spring, accepts the ground contact between the screen cross 10 via the second latch formation 15.2 to the metallic, electrically conductive front plate insert 75.

Figure 8:
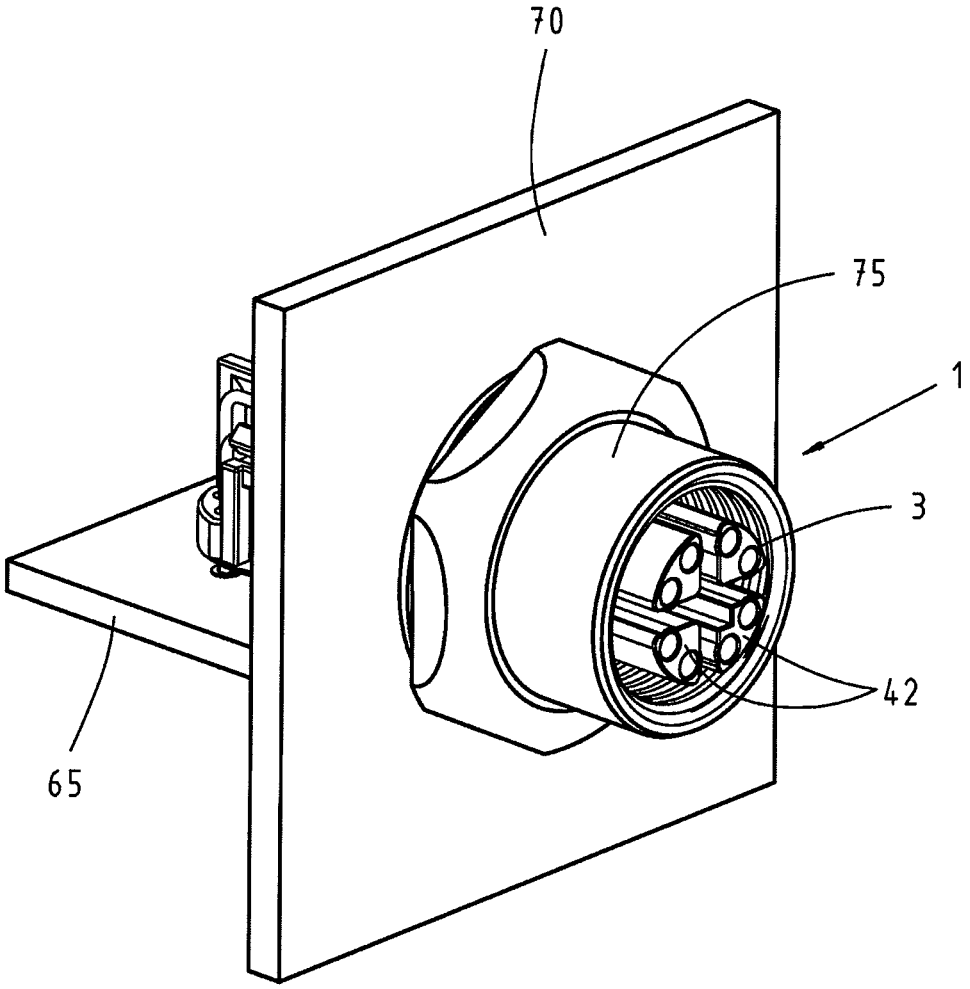
FIG. 8 a view of the connector side of the plug-in connector in a front-plate application.

For example in FIG. 8 a front plate insert 75 is provided for the round plug-in connector 1, into which the round body 40 can be inserted, with via the screen spring 60 a contacting of the ground currents to the general housing mass being ensured by the front plate 70. This way, in principle, each of the four segments 42 of the complete plug-in connector 1 is hermetically and optimally sealed against external voltages with the electric contacts 30 arranged therein.

In the state plugged to the counter plug its screen cross then engages the cruciform plug-in face, formed by the four segments 42 of the round body 40, so that a continuous insulation of the signal wires is yielded in the four segments.

Figure 9:
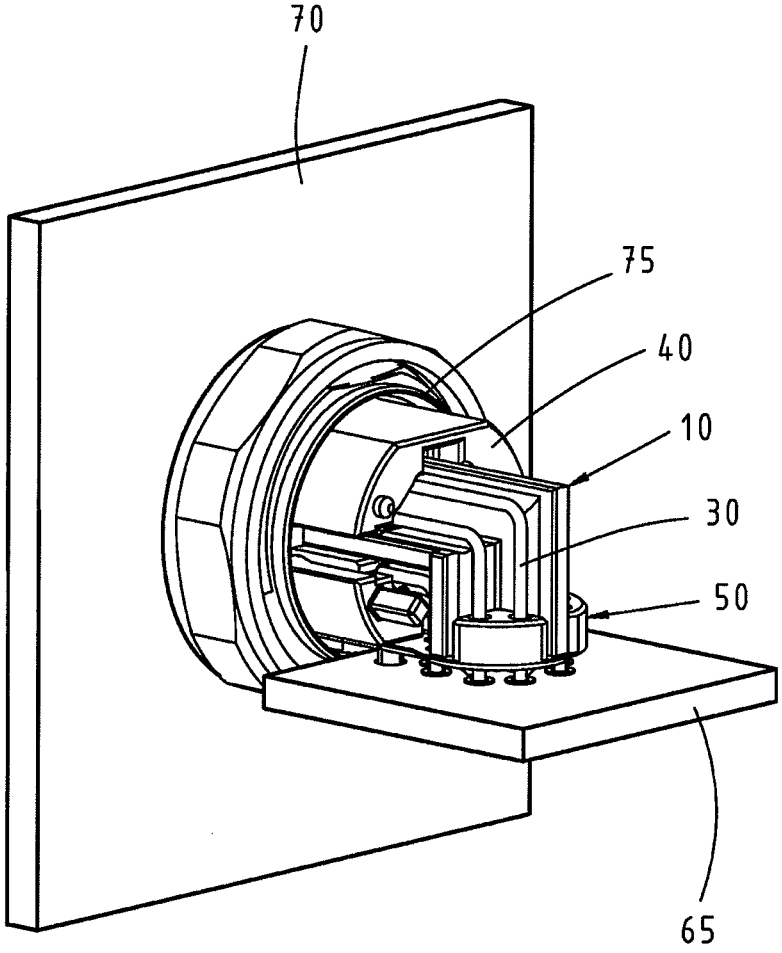
FIG. 9 a view of the connector side of an angular plug-in connector on a circuit board in a front-plate application of a front plate, and FIG. 10 a straight plug-in connector, assembled perpendicular on a circuit board, surrounded by a front-plate insert.

FIG. 9 shows an angular plug-in connector 1 in a connection-side perspective, fixed on a circuit board 65 and "floating" in an insulating sheath, with a front-plate insert 75 being inserted. This means that the plug-in connector 1 is here relatively exposed, the contacting with the screen spring is encased by the front plate insert 75 being screwed to a front plate 70, with a counter plug to be contacted however being screwed tight to the front plate insert 75 or can be fastened by way of latching.

Figure 10:
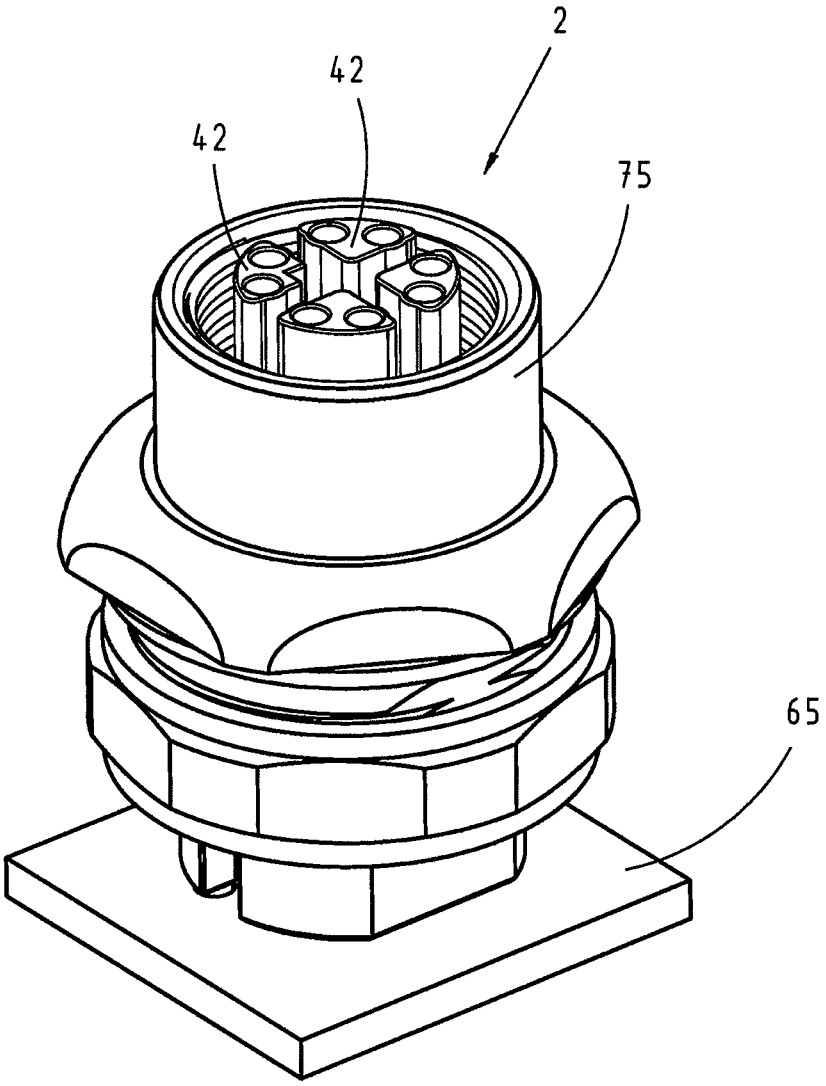

FIG. 10 shows a variant of the plug-in connector 2 in a so-called straight embodiment. This means that the electric contacts are embodied straight with the same length. Such a plug-in connector is placed perpendicular onto the circuit board 65, as shown here.

Additionally, a front plate insert 75 is shown, pushed onto the plug-in connector 2.

However in all applications, an insulation of the signals, secure from interfering radiation, is provided for the plug-in connector 1, 2 at least by the front plate insert 75.

The housing can accordingly be formed either as a "sheath", and is installed as a front plate insert 75, for example into a plastic housing, in which one or more plug-in connectors 1 are already arranged on a circuit board 65 according to the alignment of the front plate insert for a plug-in connection with a counter-plug. Or the circuit board with the plug-in connectors arranged thereon is completely arranged in a metallic or electrically conductive housing 80, also for a plug-in connection with corresponding counter connectors.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

LIST OF REFERENCE CHARACTERS

Plug-in Connector for Differential Data Transmission

Ref.: P 210-40 DE P1 9

1 plug-in connector, angular
2 plug-in connector, straight
3 plug-in side
4
5 connection side
10 screen cross, electrically conductive
11 vertical wall
12 horizontal wall
13 90° angular wall
14 plug-in side
15.1 $1^{st}$ latch formation for contact carrier
15.2 $2^{nd}$ latch formation for round body
16 quadrant of the screen cross
17 ground pin
18 groove for bead 26
20.0 contact carrier, injection molded on 10
20.1 contact carrier, can be pushed on in one piece
20.2 contact carrier, can be pushed on centrally, in two pieces
20.3 contact carrier, can be latched onto each other, in two pieces
20.4 contact carrier, can be latched onto each other, in four pieces
20.5 contact carrier, four segments with film joint
20.6 segments
20.7 film joints
21 external edges
21.2 recesses in the external edges at 20.2
22 internal edge, equal leg length
23 accepting grooves
24.1 $1^{st}$ section angular, for polarization
24.2 $2^{nd}$ section round, for latching
24.3 $3^{rd}$ section round, for guidance
25.1 latching means for 20.2
25.2 latching means for 20.3, 20.4
25.3 latching means for 20.5
26 bead at the contact carrier for groove 18
27 longitudinal grooves for pushing onto 20.1
28 latching hooks for contact carrier
29 hollow cross
30 contacts, wire contacts
31 plug-in side (pin or socket)
32.1 $1^{st}$ section, connection end (angular), soldered side
32.2 $2^{nd}$ section, four sided section for polarization
32.3 $3^{rd}$ section, latching section, round
32.4 $4^{th}$ section, guidance section, round
40 round body
41 plug-in side
42 reference circle segments
43 bore hole for contacts
44 longitudinal slot for latching
45 latching hook
46 annular groove
47 fixation pin for perpendicular assembly
50 positioning aid
51 disk
52 quarter-circle section
53.1 bore hole for contacts in 52
53.2 bore hole for contacts in 51
54 bore hole for ground pin 17
55 fixation pin for LP
56 spacer, cruciform for reflow soldering (not visible)
57 fixation pin for round body
60 screen spring
65 circuit board
70 front plate
75 front plate insert
80 housing

What is claimed is:

1. A plug-in connector for a differential signal and data transmission, comprising:

electric contacts, each in pairs, arranged in a segment of a cruciform structure, the cruciform structure including two walls, aligned perpendicular to each other, in a form of an equal, longitudinally expanding, and electrically conductive screen cross, the screen cross at least sectionally surrounded by an approximately cruciform contact carrier having a material of construction that is an electrically insulating material, the cruciform, structure of the contact carrier having corner sections that include an internal edge, which are associated with accepting grooves, in which the electric contacts are arranged to be axially parallel aligned, and an electrically insulating round body that surrounds the contact carrier together with the electric contacts, with the electric contacts having (i) a plug-in end and a connection end, and with the connection end being angled by approximately 90° from an axis of the plug-in connector, and (ii) a plurality of sections that are differently configured from one another that provide for correct insertion thereof into a corresponding plurality of the accepting grooves of the contact carrier.

2. The plug-in connector according to claim 1, wherein the electrically insulating round body includes a circumferential groove approximately centered in reference to a length thereof, in which a screen spring is inserted, with the screen spring contacting, via slots provided in the round body, the electrically conductive screen cross and a front plate insert surrounding the round body and insulating the round body electrically.

3. The plug-in connector according to claim 1, wherein the contact carrier is connected in a fixed manner and in one piece to the screen cross in an injection molded configuration.

4. The plug-in connector according to claim 1, wherein the contact carrier is configured as one piece or as a plurality of parts that push on and encompass the screen cross.

5. The plug-in connector according to claim 1, wherein the contact carrier that encompasses the screen cross is configured as a plurality of parts, and is provided with a latching element that latches onto the screen cross.

6. The plug-in connector according to claim 1, wherein the contact carrier that encompasses the screen cross includes a plurality of segments which are connected to each other via hinge connections and latching elements that latch onto the screen cross.

7. The plug-in connector according to claim 1, wherein the walls, aligned perpendicular to each other, each include opposite first latch formations that latch to the contact carrier and second latch formations that latch to the round body.

8. The plug-in connector according to claim 7, wherein the round body includes at least one longitudinal slot that latches to the second latch formations on the screen cross, with the longitudinal slot joining a circumferential groove on the round body and a screen spring that is inserted in the circumferential groove.

9. The plug-in connector according to claim 1, wherein the electric contacts inserted in the accepting grooves are aligned at connection ends thereof via a positioning aid, with the positioning aid including circular arranged openings, distributed over two levels, through which the connection ends of the electric contacts are guided to provide a precise positioning with respectively correlating contact bore holes on a circuit board.

10. The plug-in connector according to claim 1, wherein a horizontal wall of the screen cross has a wall oriented perpendicular thereto, angled by 90° laterally relative to a longitudinal direction of the screen cross.

11. The plug-in connector according to claim 1, wherein each of the plurality of the electric contacts has a first section, a second section, a third section, and a fourth section.

12. The plug-in connector according to claim 11, wherein each of the corresponding plurality of the accepting grooves of the contact carrier has a first section, a second section, a third section, and a fourth section.

13. The plug-in connector according to claim 1, wherein each of the plurality of the electric contacts is secured by a snap fit into the corresponding one of the plurality of the accepting grooves of the contact carrier.

14. A plug-in connector for differential signal and data transmission, comprising:

a plurality of paired electric contacts arranged in a segment of a cruciform structure, the cruciform structure including a first wall and a second wall, aligned perpendicular to each other, and configured as an equal, longitudinally expanding, and electrically conductive screen cross, the screen cross being at least sectionally surrounded by an approximately cruciform contact carrier having a material of construction that is electrically insulating, the contact carrier including corner sections having an internal edge that is associated with accepting grooves in which the plurality of electric contacts are arranged to be axially aligned in parallel, and reference circle segments each having a first bore hole and a second bore hole therein at a plug-in side of the plurality of electric contacts, with the contact carrier, the plurality of electric contacts, and the reference circle segments being surrounded by an electrically insulating cylindrical body, and with the plurality of electric contacts having (i) a plug-in end and a connection end, and with the connection end being angled by approximately 90° from an axis of the plug-in connector, and (ii) a plurality of sections that are differently configured from one another that provide for correct insertion thereof into a corresponding plurality of the accepting grooves of the contact carrier.

15. The plug-in connector according to claim 14, wherein the plurality of electric contacts at the plug-in side of the plug-in connector are configured as sockets or pins.

16. The plug-in connector according to claim 14, wherein the first wall and the second wall of the screen cross at least partially engage between the reference circle segments.

* * * * *